US006119672A

United States Patent [19]

Closson

[11] Patent Number: 6,119,672

[45] Date of Patent: Sep. 19, 2000

[54] SIGHTING DEVICE FOR USE ON BOWS

[75] Inventor: Robert A. Closson, Townsend, Mont.

[73] Assignee: Sight Master, Inc., Townsend, Mont.

[21] Appl. No.: 09/455,025

[22] Filed: Dec. 6, 1999

[51] Int. Cl.[7] ..... F41G 1/467

[52] U.S. Cl. ..... 124/87; 33/265

[58] Field of Search ..... 33/265; 127/87

[56] References Cited

U.S. PATENT DOCUMENTS 5,092,052 3/1992 Godsey ..... 33/265

5,465,491 11/1995 Thell ..... 33/265

5,975,069 11/1999 Hamm et al. ..... 124/87

*Primary Examiner*—John A. Ricci

*Attorney, Agent, or Firm*—Breiner & Breiner

[57] ABSTRACT

A sight is adjustable in two modes. A lever mounted on a support is pivotable in a vertical plane to vertically adjust an associated sight element carrier plate. The lever is preferably also adjustable independent of the carrier plate to facilitate convenient recalibration or fine tuning of the sight without making other adjustments such as changing the distance indicia on the support. In another embodiment, a lever pointer is adjustable independent of the lever.

18 Claims, 2 Drawing Sheets

FIG. 3
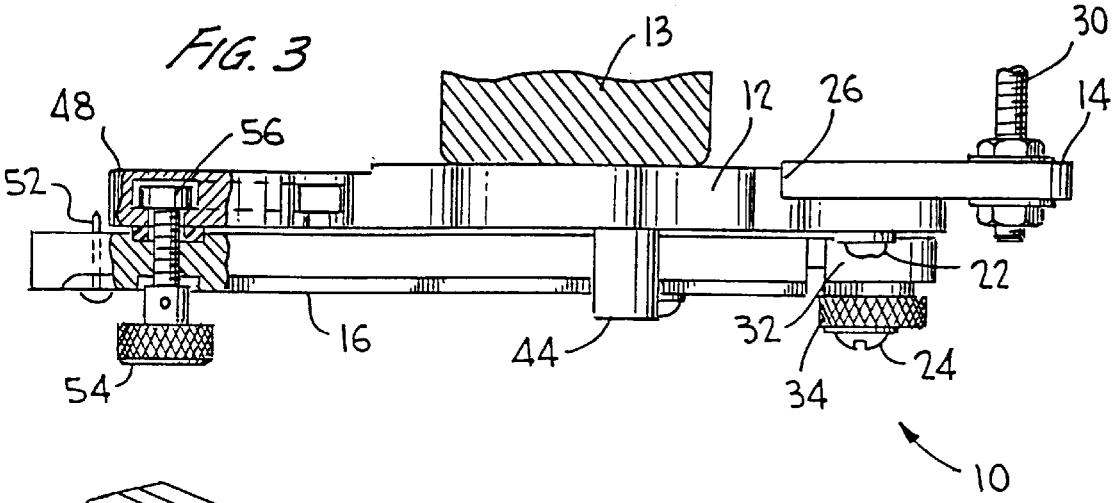
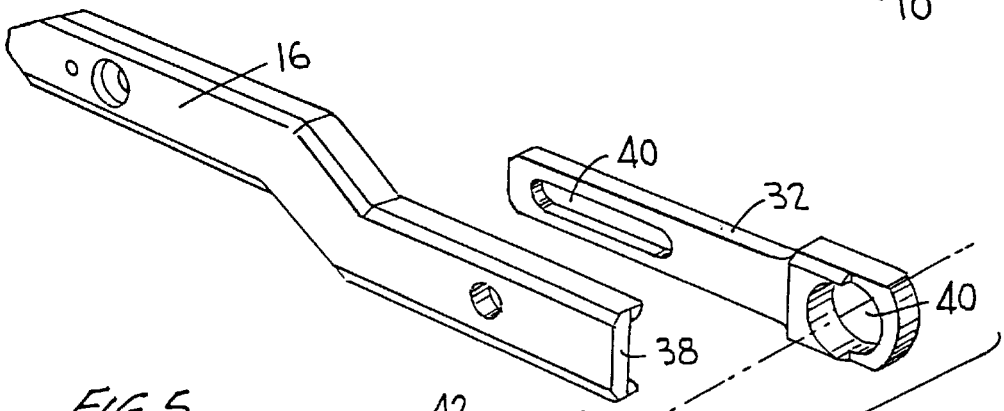
FIG. 5
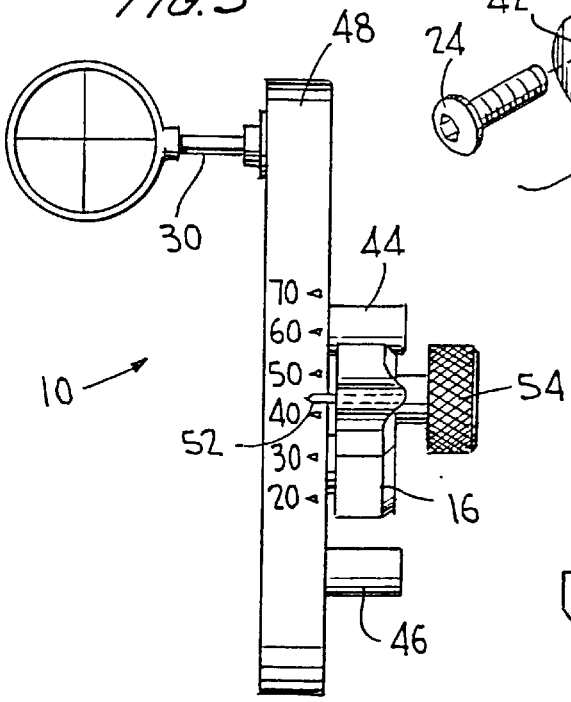
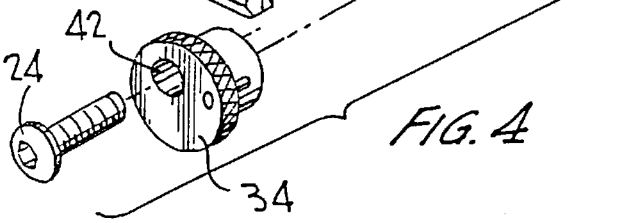
FIG. 4
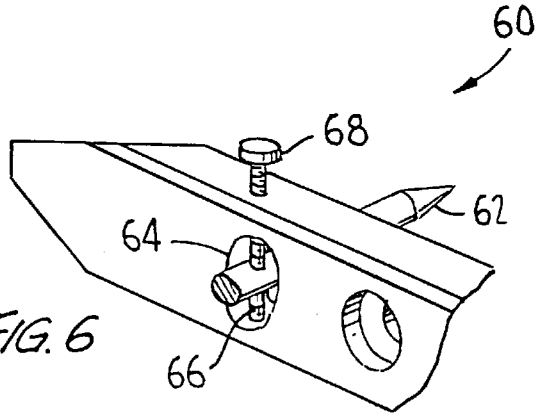
FIG. 6

SIGHTING DEVICE FOR USE ON BOWS

FIELD OF THE INVENTION

This invention relates to new and useful improvements in sighting devices, and more particularly to a sighting device for use on bows.

BACKGROUND OF THE INVENTION

Due to the speed of a traveling archery arrow, its ballistics are strongly affected by gravity. It follows that the parabolic path followed by an arrow is largely dependent upon the distance to a target. This is taken into account when calibrating the vertical position of a bow sight to a particular target distance.

Adjustable bow sights which allow a sight element to be vertically adjusted to accommodate a range of target distances are well known in the art. For example, my U.S. Pat. No. 4,541,179 describes a bow sight wherein a sight carrier plate is adjustably attached to a support by both a lever and a linking piece. The lever can be pivoted about a hollow rivet which connects the lever to the support. Adjusting the lever causes the carrier plate to travel vertically, thereby altering the elevation of a sighting element on the carrier plate as desired. While my sight has been highly successful, there is a further need for a bow sight having a means for even quicker and more precise fine tuning and recalibration.

U.S. Pat. No. 5,092,052 describes another adjustable bow sight having a base plate, a vertically adjustable sight mounting plate engaging linear tracks and a retaining plate. This sight also fails to meet the above identified needs.

Adjustable sights such as in my U.S. Pat. No. 4,541,179 can be calibrated experimentally by firing arrows at a target from several measured distances. Further, a sight support can be provided with a vertically oriented arcuate gauge at a convenient location near the rear of the sight. A lever which is pivotably connected to the support controls the elevation of a sighting element. Normally, the rear end of the lever is configured to travel in a path along the gauge which can accordingly be marked with, for example, an adhesive tape having distance indicia according to experimentally determined lever positions.

In practice, however, the distance settings made on an adjustable sight are only accurate for the particular arrow weight, tip weight and bow weight used to calibrate the sight. Individual shooting characteristics also affect the calibration settings. As a result, once a sight has been distance calibrated, frequent removal and resetting of the indicia on a sight's gauge to fine tune the distance calibration or recalibrate the sight according to various other operating variables is still required.

The Pro Tape adjustable yardage marker for the bow sight of my U.S. Pat. No. 4,541,179 (sold by Sight Master, Inc. of Townsend, Mont.) addresses this problem successfully. This device generally comprises a piece of aluminum which is fastened to the arcuate end of the sight by screws and having tape distance markings thereon. The screws can be loosened to linearly adjust the marker, eliminating any need to remove the tape or alter the distance indicia.

U.S. Pat. No. 5,465,491 also discloses an adjustable yardage plate having markings which are removable with a solvent.

There remains, however, a need for an improved bow sight having an adjustment mechanism for even quicker and more precise fine tuning and recalibration. The bow sight should also be precise, sturdy and simple to use.

SUMMARY OF THE INVENTION

It is therefore a primary object of the present invention to provide an improved sight.

It is another primary object of the invention to provide an improved adjustable sight.

It is another object of the present invention to provide a precision adjustable sight having means for fine tuning and recalibrating the sight according to shooting variables.

It is another object of the present invention to provide an adjustable sight capable of being mechanically recalibrated without moving or removing existing distance indicia on a sighting gauge.

It is another object of the present invention to provide an adjustable sight having two modes of adjustability.

It is another object of the present invention to provide an adjustable sight having a lever that is pivotable independent of an associated carrier plate.

It is another object of the present invention to provide an adjustable sight having a carrier plate that is vertically adjustable independent of an associated pivotable lever.

It is another object of the present invention to provide an adjustable sight having a distance pointer attached to a lever and vertically adjustable relative to the lever.

It is further an object of the present invention to provide an adjustable sight combining the characteristics of precision, durability, simplicity of construction and easy operation.

These and other objects of the present invention are achieved by a sight according to the following description and claims.

In a preferred embodiment of the present invention, an adjustable sight is provided having a support capable of being vertically mounted on one side of a bow. The support includes an arcuate gauge at a rear end and attachment means for a carrier plate near a front end. A control lever is pivotably attached at an intermediate pivot position on one side of the support. The lever also has a forward sliding extension slidably attached thereto. The sliding extension is pivotably attached to a vertically adjustable carrier plate. This configuration allows the lever to freely pivot in a vertical plane, with resulting vertical translation of the carrier plate. The sliding extension effectively adjusts the length of the lever through its movement, wherein it traces an arc. The lever also has a rear section behind the pivot position that tracks the gauge.

Preferably the sight also includes a second mode of adjustability for fine tuning the sight or recalibrating according to variables such as arrow weight, as described above. In one preferred embodiment, a rotating cam is provided in conjunction with the carrier plate attachment means. The cam operates to adjust the position of the sliding extension and lever in relation to the carrier plate without any carrier plate movement. This independent adjustment of the lever is important because it eliminates the need to alter distance indicia on the gauge of the support when fine tuning or recalibrating the sight. Instead, the user can quickly and easily adjust the cam, which in turn moves the lever independent of the carrier plate. As described in greater detail below, the lever can also be provided with locking means, wherein the carrier plate is movable relative to the lever when the lever is locked in a particular position.

The cam is preferably integrated with the carrier plate attachment means. This allows the sliding extension to function in a dual role, by adjusting its position according to (1) the carrier plate position and (2) the cam setting. However, any suitable means for adjusting the position of the lever indicated on the gauge independent of the carrier plate (or vice versa) will be effective.

For example, in another preferred embodiment of the present invention, secondary adjustability is provided by an adjustable distance pointer. The pointer is attached to the lever and positioned to indicate the lever's position relative to the gauge. The pointer is made vertically adjustable on the lever such that it can travel relative to the gauge without any lever or carrier plate movement.

BRIEF DESCRIPTION OF THE DRAWINGS

For a better understanding of the present invention, as well as other objects and features thereof, reference is made to the following detailed description of the presently preferred embodiments in connection with the accompanying drawings, wherein:

FIG. 3 is a top view of the sight of FIG. 1;

FIG. 4 is an exploded view of the pivoting assembly of the sight of FIG. 1;

FIG. 5 is the sight of FIG. 2 viewed along line 5—5; and

FIG. 6 is a section of a lever according to the present invention.

DETAILED DESCRIPTION AND PRESENTLY PREFERRED EMBODIMENTS

Figure 1:
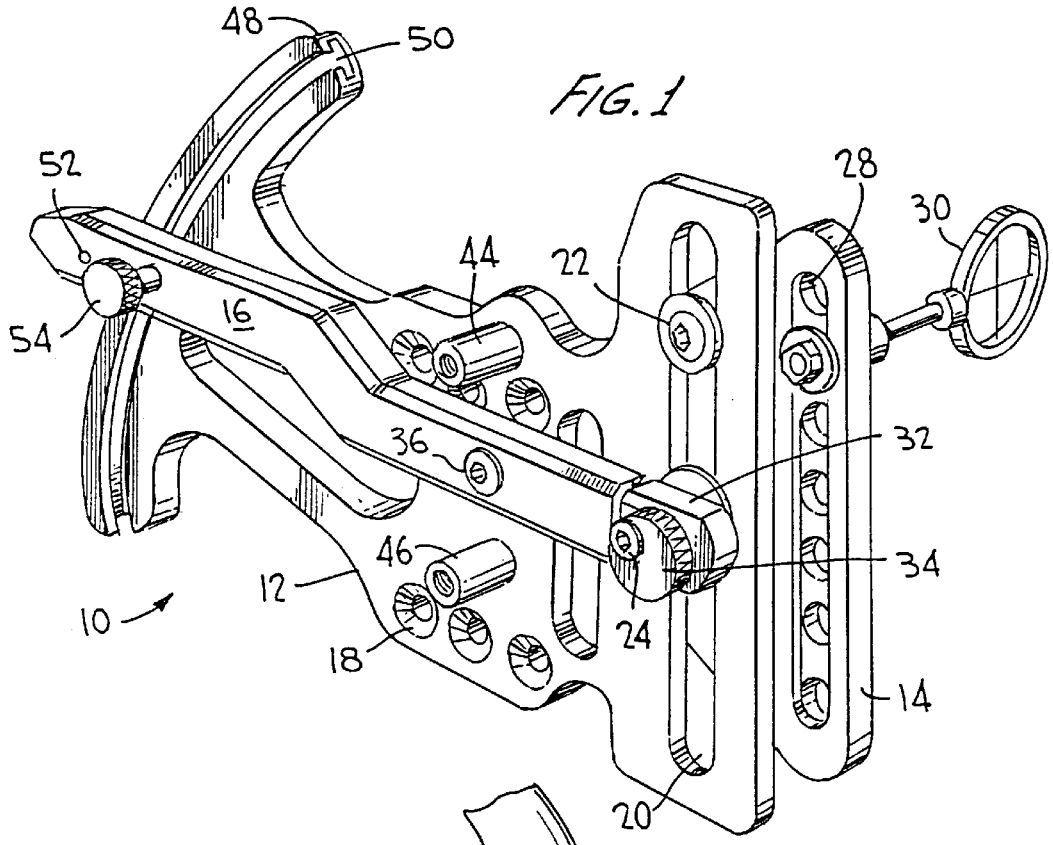
FIG. 1 is a perspective view of an adjustable sight according to the present invention.
Figure 2:
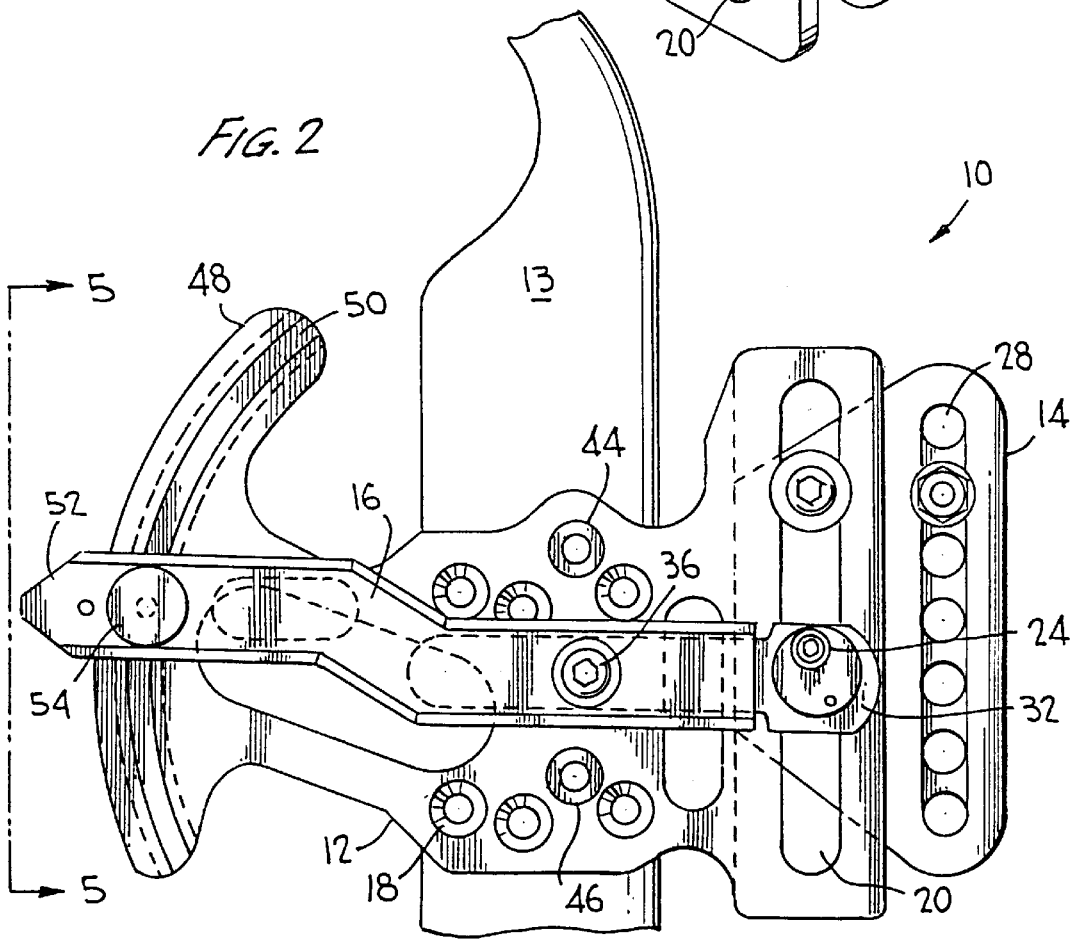
FIG. 2 is a side view of the sight of FIG. 1.

Referring to the drawings, a preferred embodiment of the sight of the present invention is shown. Sight 10 includes support 12, carrier plate 14 and lever 16.

Support 12 is preferably provided with apertures 18 for attaching the sight in a vertical orientation to one side of a bow 13. Also in accordance with the present invention, any suitable means for securely attaching the support may be used. Support 12 also has vertical slot 20 with attachment means 22 and 24 extending therethrough. Although not limiting or necessary to the invention, slot 20 is the preferred means for restricting carrier 14 to vertical movement. Attachment means 22 and 24 are preferably provided with washers between support 12 and the attachment.

Carrier plate 14 is vertically adjustable relative to support 12. Preferably, the rear facing vertical surface 26 of carrier 14 (FIG. 3) slidably abuts an opposing vertical forward facing surface on support 12. This relationship in conjunction with attachments 22 and 24 at slot 20 restrict carrier 14 to vertical movement. Apertures 28 or any other suitable means can be used to attach a sighting element 30 to carrier plate 14. Apertures 28 are preferred because they afford additional flexibility for calibrating and configuring the sight.

Lever 16 is pivotable about an axis defined by attachment means 36. Attachment means 36 can be a rivet or any other pivotable attachment and can include washers on either side of lever 16. The embodiment shown employs a lever 16 having a bend behind attachment 36. This bend is provided for convenience in the positioning of the rear section of lever 16 in relation to gauge 48, discussed in greater detail below, but is not limiting or necessary to the invention.

Referring now to FIG. 4 in particular, lever 16 is provided with sliding extension 32 and rotating cam 34 operable on attachment means 24. In order for vertically movable attachment means 24 to accommodate the arc traced by the pivoting lever 16, extension 32 effectively makes the length of lever 16 between attachment 36 and attachment 24 adjustable. Extension 32 is limited in its movement to longitudinal extension and retraction and for this purpose can be configured to fit within longitudinal slot 38 in lever 16 and held on an opposite side against support 12. Preferably, extension 32 also includes a longitudinal slot 40 which receives attachment 36, although this is also not necessary to the invention.

Cam 34 provides a second mode of adjustability for sight 10. Cam 34 fits rotatably within aperture 40 of extension 32 and cam 34 itself has an offset aperture 42 which receives attachment means 24. Rotation of cam 34 effects an adjustment in the position of extension 32 relative to attachment 36 with resulting pivoting movement of lever 16. Importantly, this movement is independent of carrier plate 14, which remains stationary. Alternatively, lever 16 can be locked in a particular angular setting, as described in greater detail below. This arrangement allows the user the converse option of adjusting the carrier plate 14 elevation while maintaining lever 16 fixed.

Optionally, posts 44 and 46 are provided extending normal to support 12 above and below lever 16. The posts provide protection for lever 16 and also can limit its range of travel as desired.

Near the rear of sight 10, support 12 includes arcuate gauge 48. Although not necessary to the invention, gauge 48 is preferably arcuate in shape in order to linearly correspond with the arc traveled by lever 16. A "T" shaped slot 50 is provided in the embodiment shown for reasons discussed hereafter. Lever 16 preferably has a pointer 52 for precisely gauging its position relative to arcuate gauge 48. Pointer 52 protrudes from lever 16 behind gauge 48. This is best seen in FIG. 5.

Further, lever 16 preferably has locking screw 54. Resilient washer means are preferably provided around screw 54 between support 12 and lever 16. Screw 54 has the purposes of stabilizing the rear end of lever 16 in its vertical plane of travel and also provides a locking function to lock lever 16 at user-selected angular positions. When locked, an archer can shoot arrows without concern that the elevation will be accidently moved. Any suitable means can be used as locking means. In the embodiment shown, screw 54 has a bottom knob 56 which engages slot 50. Counter-clockwise rotation of screw 54 draws the components together to secure lever 16 in the desired position along gauge 48. When lever 16 is locked, carrier plate 14 is adjustable by operation of cam 34. In an example of operation, if an archer is shooting arrows at a target from a particular distance and wishes to change arrow weight, he can place screw 54 in a locked position while rotating cam 34 to adjust the elevation of carrier plate 14 until it reaches the appropriate height for the new arrow.

In another preferred embodiment of the present invention, secondary adjustability is achieved without a cam such as cam 34. In this embodiment the pointer is itself vertically adjustable relative to the lever. This allows for recalibration or fine tuning of the sight without altering the gauge and can be achieved by any suitable means. For example, referring to FIG. 6, lever 60 is shown. Pointer 62 can be provided within a vertical slot 64 in the rear of lever 60 and protruding therefrom. A rotatable screw 66 having an adjustment knob 68 is vertically threaded through lever 60 and through pointer 62 such that rotation of the adjustment knob causes vertical translation of the pointer. This embodiment achieves an important object of the invention, that being adjusting the shooting distance indicated on the gauge independent of the carrier plate or adjusting the carrier plate elevation independent of the pointer or lever position.

The sight of the present invention can be made from any suitable materials. Aluminum or plastic are currently preferred for making the major structural components due to their strength, light weight and corrosion resistance.

It is understood that the presently preferred embodiments are not limiting to the invention. Many additional useful embodiments can be made by one of skill in the art within the spirit of the present invention and scope of the appended claims.

It is claimed:

1. An adjustable sight comprising:

a support constructed and arranged to be mounted on a bow;

a lever having a longitudinal dimension and having an intermediate mount on a first surface of said support, said lever having front and rear sections, said lever being pivotable in a vertical plane about said intermediate mount;

said lever having a slidable extension associated to said front section, said extension slidable in said longitudinal dimension;

a carrier plate for receiving a sighting element; and said carrier plate having a pivotable connection to said slidable extension and movable vertically in relation to said support.

2. An adjustable sight according to claim 1, wherein said slidable extension further comprises a cam for adjusting the position of said slidable extension in relation to said carrier plate pivotable connection to cause relative movement between said lever and said carrier plate.

3. The sight of claim 2, wherein said cam comprises a rotatable round knob set within a first aperture in said slidable extension, said knob including an offset second aperture extending therethrough and said carrier plate pivotable connection extends through said second aperture.

4. The sight of claim 3, wherein said support has a vertical slot located between said carrier plate and said lever extension and said carrier plate pivotable connection extends through said vertical slot.

5. The sight of claim 4, further comprising a secondary carrier plate connection slidably attaching said carrier plate to said support through said vertical slot.

6. The sight of claim 5, wherein said carrier plate includes at least one aperture for attachment of said sighting element.

7. The sight of claim 6, wherein said lever includes at least one angular bend.

8. The sight of claim 2, wherein said support further includes an arcuate gauge positioned and configured such that said lever rear section can move in a path along said gauge; and said rear section further comprising a pointer cooperating with said gauge to indicate the position of said lever.

9. The sight of claim 8, wherein said gauge includes a groove facing said lever and said lever has a locking screw engaging said groove and capable of securing said lever at any angular position along said gauge.

10. The sight of claim 9, wherein said gauge includes numerical indicia of distance.

11. An adjustable sight comprising:

a support constructed and arranged to be mounted on a bow;

a lever having a longitudinal dimension and having an intermediate mount on a first surface of said support, said lever having front and rear sections, said lever being pivotable in a vertical plane about said intermediate mount;

a carrier plate for receiving a sighting element;

said carrier plate is movable vertically in relation to said support and said carrier plate has a pivotable connection to said lever;

said support further includes an arcuate gauge positioned and configured such that said lever rear section can trace in a path along said gauge;

said rear section further comprising a pointer cooperating with said gauge to indicate the position of said lever; and said pointer is adjustable relative to said lever and said gauge.

12. The sight of claim 11, wherein said lever includes a slidable extension associated to said front section and slidable in said longitudinal dimension and said carrier plate connection is to said slidable extension.

13. The sight of claim 12, wherein said support has a vertical slot located between said carrier plate and said lever extension and said carrier plate pivotable connection extends through said vertical slot.

14. The sight of claim 13, further comprising a secondary carrier plate connection slidably attaching said carrier plate to said support through said vertical slot.

15. The sight of claim 14, wherein said carrier plate includes at least one aperture for attachment of said sighting element.

16. The sight of claim 15, wherein said lever includes at least one angular bend.

17. The sight of claim 16, wherein said gauge includes a groove facing said lever and said lever has a locking screw engaging said groove and capable of securing said lever at any angular position along said gauge.

18. The sight of claim 17, wherein said gauge includes numerical indicia of distance.

* * * * *